US012180736B2

(12) United States Patent
Richison

(10) Patent No.: US 12,180,736 B2
(45) Date of Patent: Dec. 31, 2024

(54) WARP RESISTANT FENCE PANEL

(71) Applicant: Brett Jason Richison, Jenks, OK (US)

(72) Inventor: Brett Jason Richison, Jenks, OK (US)

( * ) Notice: Subject to any disclaimer, the term of this patent is extended or adjusted under 35 U.S.C. 154(b) by 0 days.

(21) Appl. No.: 18/424,390

(22) Filed: Jan. 26, 2024

(65) Prior Publication Data

US 2024/0360690 A1 Oct. 31, 2024

Related U.S. Application Data

(60) Provisional application No. 63/442,047, filed on Jan. 30, 2023.

(51) Int. Cl.
*E04H 17/16* (2006.01)

(52) U.S. Cl.
CPC ..... *E04H 17/1602* (2021.01); *E04H 17/165* (2013.01)

(58) Field of Classification Search
CPC ... E04H 17/16; E04H 17/1602; E04H 17/165; E04H 17/166; E04H 17/168
See application file for complete search history.

(56) References Cited

U.S. PATENT DOCUMENTS 5,233,810 A * 8/1993 Jennings ..... E04H 17/168 52/745.19
5,702,090 A * 12/1997 Edgman ..... E04H 17/1426 256/65.02
6,726,183 B2 * 4/2004 Wiley ..... E04H 17/16 256/65.01
8,769,904 B1 * 7/2014 Brandt ..... E04C 2/46 52/177
9,869,099 B2 1/2018 Qu et al.
10,190,331 B2 1/2019 Delafield et al.
2003/0020057 A1 * 1/2003 Sciandra ..... E04H 17/1602 256/24
2004/0009338 A1 1/2004 Jo et al.
2005/0098771 A1 * 5/2005 DeMaere ..... E04H 17/1447 256/65.02
2005/0255305 A1 11/2005 Jo et al.
2007/0062146 A1 * 3/2007 Van Dijk ..... E04C 2/22 52/580

(Continued)

FOREIGN PATENT DOCUMENTS

AU 2017203787 A1 3/2018
CA 2488686 A1 * 5/2006 ..... E04H 17/168

(Continued)

*Primary Examiner* — Jonathan P Masinick
(74) *Attorney, Agent, or Firm* — James F. Lea, III; Gable Gotwals

(57) ABSTRACT

A fence having a frame for receiving fence panels and the fence panels that are preferably received in the frame vertically or horizontally. The fence panel has a reinforcing structure surrounded by panel structure for preventing bowing due to differential heating over the panel. The reinforcing structure may have longitudinal members separated by cross-members for forming channels, and may have external tab portions to facilitate connection with the panel structure. The panel structure may define a tongue and groove for matingly fitting with adjacent panels. The width of the reinforcing structure, and panel structure material on either side of the reinforcing structure preferably define equal thicknesses.

30 Claims, 5 Drawing Sheets

(56) References Cited

U.S. PATENT DOCUMENTS

| | | | | |
|---|---|---|---|---|
| 2007/0181865 | A1* | 8/2007 | Hein | E04H 17/16 256/24 |
| 2019/0145124 | A1* | 5/2019 | Ohrstrom | E04H 17/166 256/24 |
| 2021/0148677 | A1* | 5/2021 | Glick | F41H 11/08 |
| 2023/0102631 | A1* | 3/2023 | Lebrija | E04H 17/20 256/65.15 |

FOREIGN PATENT DOCUMENTS

| | | | | | |
|---|---|---|---|---|---|
| CN | 203924888 | U | | 11/2014 | |
| CN | 105178696 | A | | 12/2015 | |
| CN | 211949938 | U | | 11/2020 | |
| CN | 217760397 | U | | 11/2022 | |
| CN | 2571938 | Y | | 9/2023 | |
| DE | 2836617 | A1 | * | 3/1980 | |
| DE | 29721717 | U1 | * | 7/1998 | E04H 17/161 |
| FR | 2930867 | A1 | * | 11/2009 | A01G 1/08 |
| FR | 2938588 | A1 | * | 5/2010 | E04C 2/205 |
| FR | 3041012 | B1 | * | 9/2017 | E04H 17/168 |
| FR | 3066211 | A3 | * | 11/2018 | E04H 17/16 |
| GB | 2306977 | A | * | 5/1997 | E04H 17/168 |
| GB | 2425317 | A | * | 10/2006 | E04H 17/1421 |
| GB | 2557340 | A | | 6/2018 | |
| KR | 20060125342 | A | * | 12/2006 | |

* cited by examiner

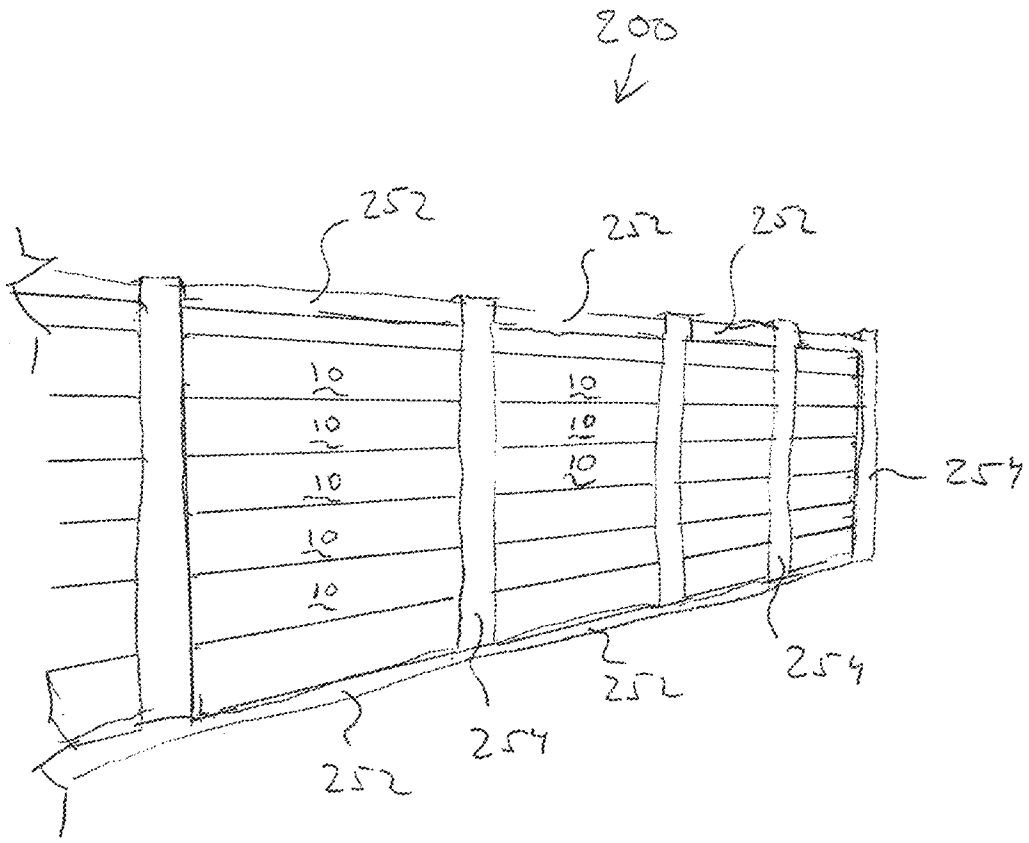
200
252
254
252
254
252
254

WARP RESISTANT FENCE PANEL

CROSS REFERENCE TO RELATED APPLICATIONS

This application claims the priority of U.S. Provisional Patent Application No. 63/442,047 titled "WARP RESISTANT FENCE PANEL," filed Jan. 30, 2023, the contents of which are hereby incorporated by reference.

FIELD OF THE INVENTION

The invention relates to fences. More particularly, the invention relates to fence panels constructed of composite, polymer or other material, wherein the fence panels are provided with anti-warping structure.

BACKGROUND OF THE INVENTION

The use of fences is widespread. Fences are available in various materials and configurations to meet the needs of consumers. For example, common fence types for residential or light commercial use include chain link fence and picket fence. However, variations of these types or configurations of fences are available to provide aesthetic alternatives for consumers. Some fence variants provide fence panels or other structure that may be placed in a fence frame in a horizontal or vertical configuration.

A panel that is installed in a fence will experience differential heating over the panel body, i.e., the sun facing side will be heated more than the shade facing side of the panel. Consequently, a panel will tend to bow towards the sun facing side. Depending on the material and the size of the panel, such bowing may be noticeable.

SUMMARY OF THE INVENTION

The invention relates to warp resistant fence panels, such as horizontal or vertical panels, that are constructed of a polymer, such as PVC or other polymers. The invention also relates to a fence constructed of such panels.

In one embodiment, a warp resistant fence panel of the invention has a reinforcing structure molded into the fence panel. In one embodiment the reinforcing structure is an extruded aluminum member. In one embodiment, the reinforcing structure defines an internal cavity for allowing the dissipation of heat. In one embodiment, the reinforcing structure is ⅓ the total thickness of the fence panel thereby allowing for ⅓ of the total thickness being comprised of polymer on each side of the reinforcing structure.

In greater detail, the fence of the invention may include a frame having vertical and horizontal members. A fence panel may be received within the frame.

The fence panel may have a reinforcing structure having a first side, a second side, a first end, a second end, a first edge and a second edge. A distance between the first side and the second side defines a width, and a distance between the first edge and the second edge defines a length. The fence panel may have a panel structure surrounding the reinforcing structure. In one embodiment, the reinforcing structure is metallic, such as extruded aluminum.

The panel structure may have a first side, a second side, a first end, a second end, a first edge and a second edge. The panel structure defines a first side thickness between the first side of the reinforcing structure and the first side of the panel structure. The panel structure defines a second side thickness between the second side of the reinforcing structure and the second side of the panel structure.

In one embodiment, the fence panel is horizontally received within the frame. In a second embodiment, the fence panel is vertically received within the frame.

In one embodiment, the reinforcing structure has a first longitudinal member on the first side and a second longitudinal member on the second side. The reinforcing structure may have cross-members between the first longitudinal member and the second longitudinal member. The cross-members define a height between the first longitudinal member and the second longitudinal member. The cross-members, the first longitudinal member and the second longitudinal member define a plurality of chambers. The chambers provide a pathway for heat to escape the fence panels. Additionally, the presence of the chambers facilitate a lower weight of the fence panel.

In one embodiment, at least one first tab portion extends outwardly from the first longitudinal member by a length, and at least one second tab portion extends outwardly from the second longitudinal member by a length. The tab portions facilitate greater connection between the reinforcing structure and the panel structure. In one embodiment, a terminal end of the tab portions define a widened portion. The widened portions facilitate even greater connection between the reinforcing structure and the panel structure.

In one embodiment, the length of the first tab portion and the length of the second tab portion is between 25% and 30% of the height of the cross-members.

In one embodiment, the panel structure defines a tongue protrusion on one of the first edge and the second edge and a groove indentation on the other of the first edge and the second edge to facilitate interconnectedness of adjacent panel structures to provide a smooth appearance.

In one embodiment, the tongue protrusion defines a terminal end surface, the groove indentation defines an inner wall surface, and the panel structure defines a longitudinal distance from the terminal end surface to the inner wall surface.

In one embodiment, the length of the reinforcing structure is between 85% and 95% of a the longitudinal distance of the panel structure.

In one embodiment, the width of the reinforcing structure, the first side thickness of the panel structure, and the second side thickness of the panel structure are approximately equal.

BRIEF DESCRIPTION OF THE DRAWINGS

FIG. 5 is an elevation view of a fence utilizing a fence panel of the invention wherein fence panels are oriented horizontally within a frame.

DETAILED DESCRIPTION OF THE PREFERRED EMBODIMENTS

The present invention relates to a fence 200 having a frame 250 for receiving panels designated generally 10.

Figure 4:
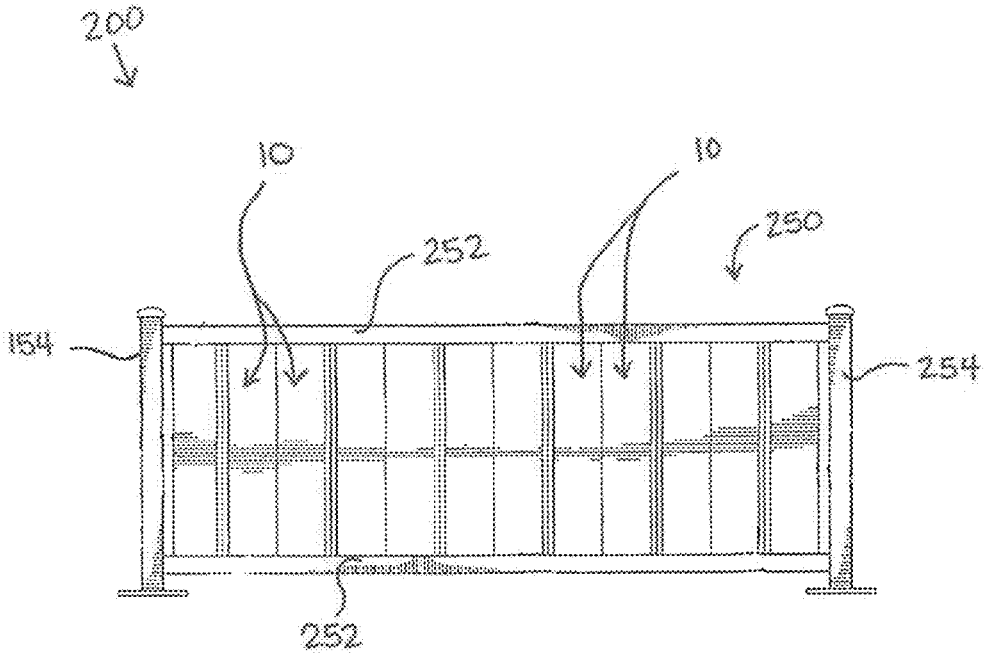
FIG. 4 is an elevation view of a fence utilizing a fence panel of the invention wherein fence panels are oriented vertically within a frame.

Panels 10 may be received in frame 200 in a vertical orientation (FIG. 4) or in a horizontal orientation (FIG. 5). Frame 250 includes horizontal members 252 and posts or vertical members 254.

Figure 1:
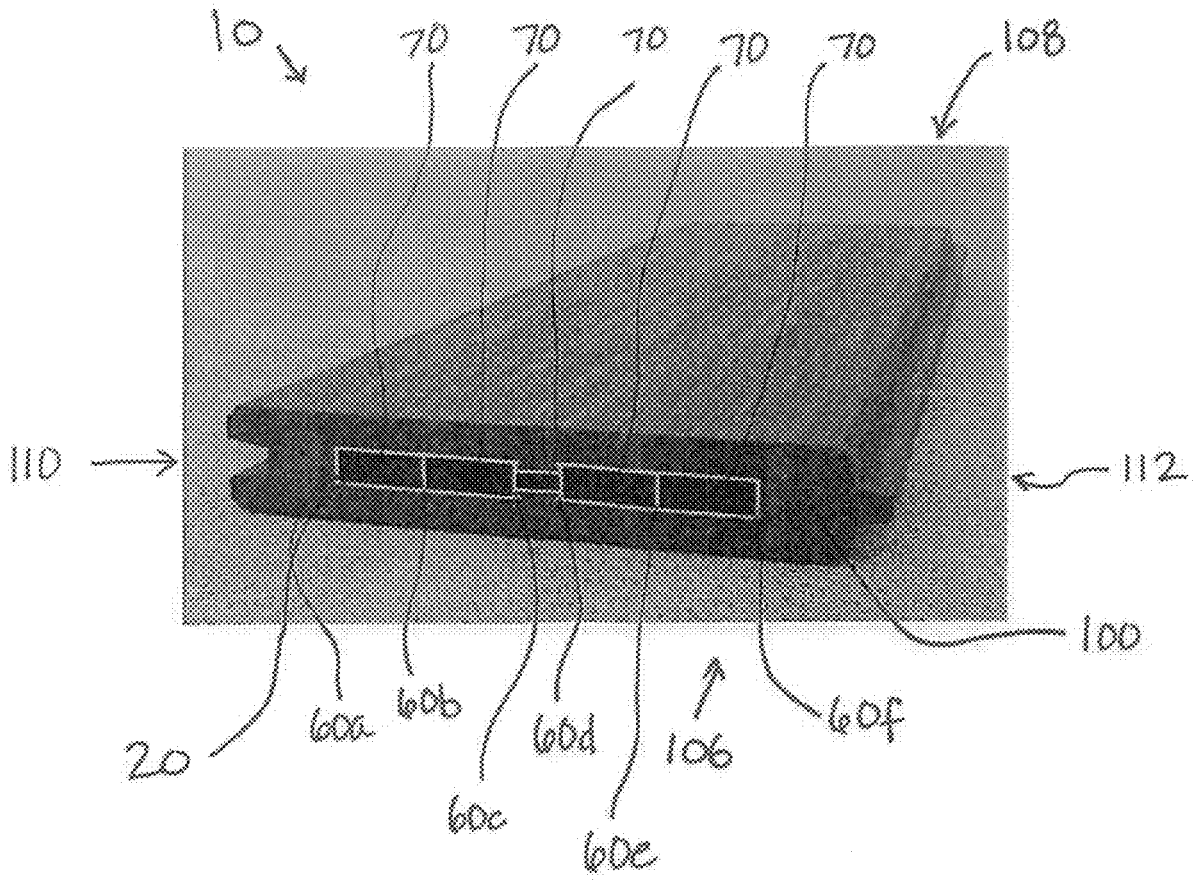
FIG. 1 is a perspective view of an embodiment of a fence panel of the invention showing an end of the fence panel wherein a reinforcing structure is visible.
Figure 2:
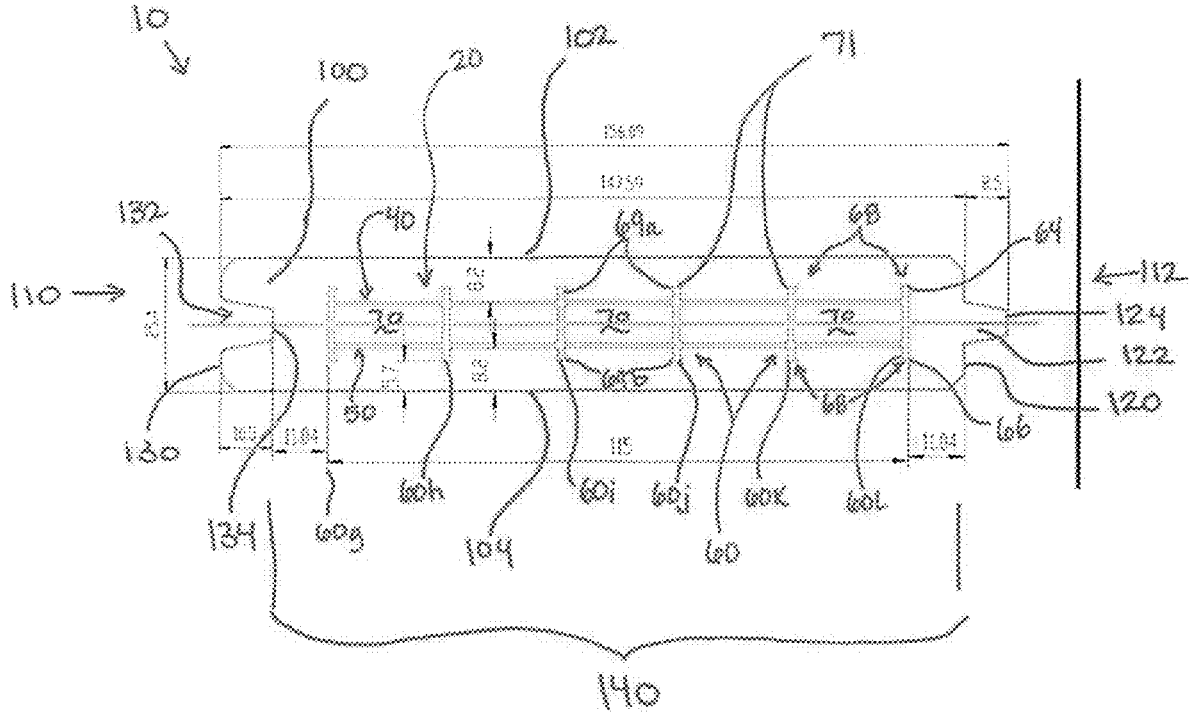
FIG. 2 is a schematic end view of an embodiment of a fence panel showing a reinforcing structure.
Figure 3:
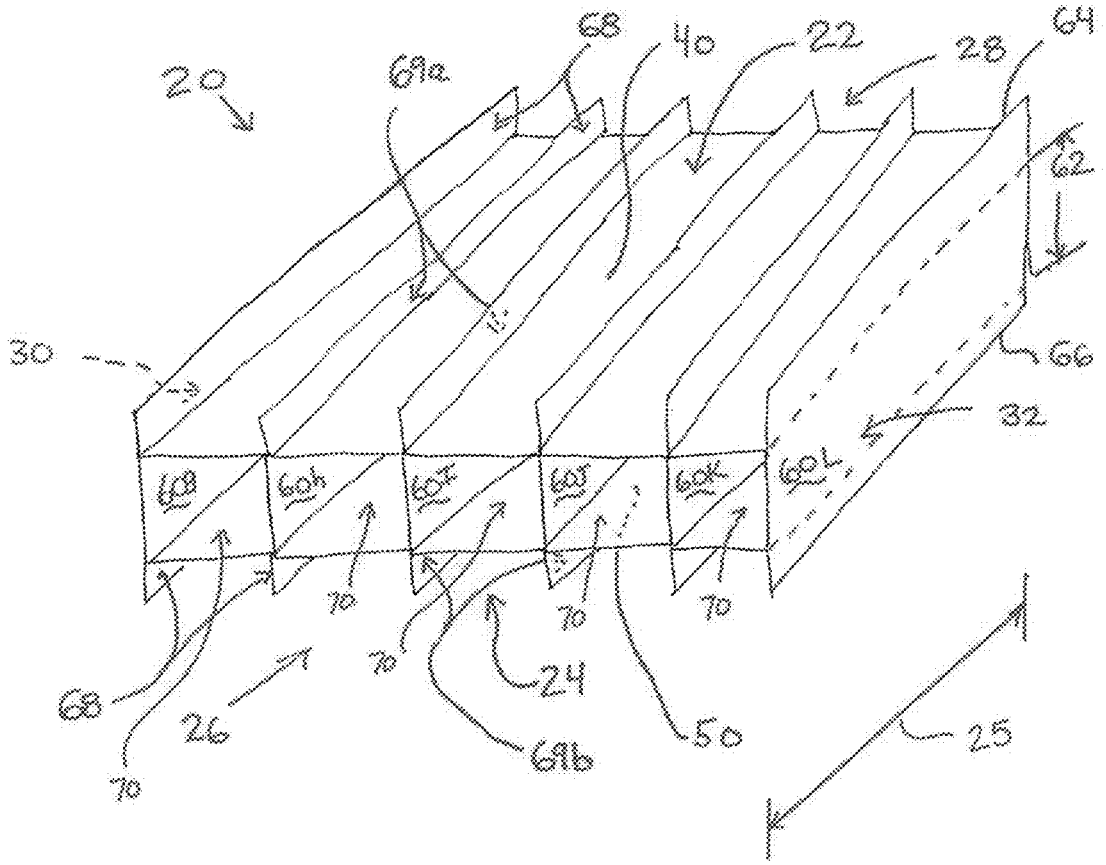
FIG. 3 is a perspective view of an example reinforcing structure.

Referring now to FIGS. 1 and 2, shown is fence panel 10 in greater detail. As best seen in FIG. 3, fence panel 10 includes a reinforcing structure 20 having a first side 22, a second side 24, a first end 26, a second end 28, a first edge 30, and a second edge 32.

Reinforcing structure 20 includes first longitudinal member 40, which forms a portion of first side 22. Reinforcing structure 20 includes second longitudinal member 50, which forms a portion of second side 24. A distance between first end 26 and second end 28 defines a length 25. First longitudinal member 40 and second longitudinal member 50 are separated from one another. A plurality of cross members 60, e.g., 60*a*-60*f* (FIG. 1) and 60*g*-60*l* (FIGS. 2, 3), that span therebetween. A distance between first longitudinal member 40 and second longitudinal member 50 defines a width 62 (FIG. 3). Each cross member has a first edge 64, and a second edge 66. In one embodiment, for example the embodiment of FIGS. 2 and 3, cross members 60 include outwardly extending tab portions designated generally 68. First tab portions 69*a* extend outwardly from first longitudinal member 40 and second tab portions 69*b* outwardly from second longitudinal member 50. In one embodiment, tab portions 68 define widened portions 71 (FIG. 2). The widened portions 71 are proximate to first edge 64 and proximate to second edge 66 of cross members 60 on tab portions 68.

In a preferred embodiment, cross members 60, first longitudinal member 40, and second longitudinal member 50 define a plurality of chambers 70.

In one embodiment, a portion of each of tab portion 69*a* that extends outside of first longitudinal member 40 and a portion of each tab portion 69*b* that extends outside of said second longitudinal member 50 by an amount that is between 20% and 30% of the distance between first edge 64 and second edge 66 of cross members 60. In one embodiment, reinforcing structure 20 is an extruded member. In one embodiment, reinforcing structure 20 is made of aluminum.

Fence panel 10 additionally includes panel structure 100 (FIGS. 1, 2). Panel structure 100 has first side 102, second side 104, first end 106, second end 108, first edge 110, and second edge 112. Panel structure 100 preferably surrounds reinforcing structure 20. In one embodiment, panel structure 100 defines a tongue and groove configuration wherein first edge 110 has outside surface 130 that defines a groove indentation 132 that includes inner wall 134. Second edge 112 has outer surfaces 120 surrounding tongue protrusion 122. Tongue protrusion 122 defines terminal end surface 124. In an embodiment having a tongue and groove configuration, panel structure 100 defines a longitudinal distance 140 from outer surface 120 to inner wall 134.

In one embodiment, first longitudinal member 40 and second longitudinal member 50 of reinforcing structure 20 define a distance between first edge 30 and second edge 32 that is between 85% and 95% of longitudinal distance 140 of panel structure 100.

Although particular embodiments have been described herein, it will be appreciated that the invention is not limited thereto and that many modifications and additions thereto may be made within the scope of the invention. For example, various combinations of the features of the following dependent claims can be made with the features of the independent claims without departing from the scope of the present invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A fence panel comprising:

a reinforcing structure having a first side, a second side, a first end, a second end, a first edge and a second edge, wherein a distance between said first side and said second side defines a width, and wherein a distance between said first end and said second end define a length;

a panel structure having a first side, a second side, a first end, a second end, a first edge and a second edge, said panel structure defining a first side thickness between said first side of said reinforcing structure and said first side of said panel structure, said panel structure defining a second side thickness between said second side of said reinforcing structure and said second side of said panel structure;

said reinforcing structure having a first longitudinal member on said first side and a second longitudinal member on said second side, cross-members between said first longitudinal member and said second longitudinal member, wherein said cross-members define a height between said first longitudinal member and said second longitudinal member, wherein said cross-members, said first longitudinal member and said second longitudinal member define at least one chamber.

2. The fence panel according to claim 1 further comprising:

at least one first tab portion extending outwardly from said first longitudinal member by a length; and at least one second tab portion extending outwardly from said second longitudinal member by a length.

3. The fence panel according to claim 2 wherein:

said at least one first tab portion has a terminal end defining a widened portion and said at least one second tab portion has a terminal end defining a widened portion.

4. The fence panel according to claim 2 wherein:

said length of said at least one first tab portion and said length of said at least one second tab portion is between 25% and 30% of said height of said cross-members.

5. The fence panel according to claim 1 wherein said reinforcing structure is metallic.

6. The fence panel according to claim 1 wherein:

said panel structure defines a tongue protrusion on one of said first edge and said second edge and a groove indentation on the other of said first edge and said second edge.

7. The fence panel according to claim 6 wherein:

said tongue protrusion defines a terminal end surface;

said groove indentation defines an inner wall surface; and said panel structure defines a longitudinal distance from said terminal end surface to said inner wall surface.

8. The fence panel according to claim 7 wherein:

said length of said reinforcing structure is between 85% and 95% of said longitudinal distance of said panel structure.

9. The fence panel according to claim 1 wherein:

said width of said reinforcing structure, said first side thickness of said panel structure, and said second side thickness of said panel structure are approximately equal.

10. A fence comprising:

a frame having vertical and horizontal members;

a fence panel received within said frame, said fence panel having a reinforcing structure having a first side, a second side, a first end, a second end, a first edge and a second edge, wherein a distance between said first side and said second side defines a width, and wherein a distance between said first end and said second end define a length, said fence panel having a panel structure surrounding said reinforcing structure, said panel structure having a first side, a second side, a first end, a second end, a first edge and a second edge, said panel structure defining a first side thickness between said first side of said reinforcing structure and said first side of said panel structure, said panel structure defining a second side thickness between said second side of said reinforcing structure and said second side of said panel structure;

said reinforcing structure having a first longitudinal member on said first side and a second longitudinal member on said second side, said reinforcing structure having cross-members between said first longitudinal member and said second longitudinal member wherein said cross-members define a height between said first longitudinal member and said second longitudinal member, wherein said cross-members, said first longitudinal member and said second longitudinal member define at least one chamber.

11. The fence of claim 10 wherein:

said fence panel is horizontally received within said frame.

12. The fence of claim 10 wherein:

said fence panel is vertically received within said frame.

13. The fence panel according to claim 10 further comprising:

at least one first tab portion extending outwardly from said first longitudinal member by a length and at least one second tab portion extending outwardly from said second longitudinal member by a length.

14. The fence panel according to claim 13 wherein:

said at least one first tab portion has a terminal end defining a widened portion and said at least one second tab portion has a terminal end defining a widened portion.

15. The fence panel according to claim 13 wherein:

said length of said at least one first tab portion and said length of said at least one second tab portion is between 25% and 30% of said height of said cross-members.

16. The fence panel according to claim 10 wherein said reinforcing structure is metallic.

17. The fence panel according to claim 10 wherein:

said panel structure defines a tongue protrusion on one of said first edge and said second edge and a groove indentation on the other of said first edge and said second edge.

18. The fence panel according to claim 17 wherein:

said tongue protrusion defines a terminal end surface;

said groove indentation defines an inner wall surface; and said panel structure defines a longitudinal distance from said terminal end surface to said inner wall surface.

19. The fence panel according to claim 18 wherein:

said length of said reinforcing structure is between 85% and 95% of a said longitudinal distance of said panel structure.

20. The fence panel according to claim 10 wherein:

said width of said reinforcing structure, said first side thickness of said panel structure, and said second side thickness of said panel structure are approximately equal.

21. A fence panel comprising:

a reinforcing structure having a first side, a second side, a first end, a second end;

a panel structure having a first side, a second side, said panel structure defining a first side thickness between said first side of said reinforcing structure and said first side of said panel structure, said panel structure defining a second side thickness between said second side of said reinforcing structure and said second side of said panel structure;

said reinforcing structure having a first longitudinal member on said first side and a second longitudinal member on said second side, said longitudinal members forming at least a portion of at least one chamber therebetween.

22. The fence panel according to claim 21 further comprising:

cross-members between said first longitudinal member and said second longitudinal member, wherein said cross-members define a height between said first longitudinal member and said second longitudinal member, wherein said cross-members, said first longitudinal member, and said second longitudinal member define said at least one chamber.

23. A fence panel comprising:

a reinforcing structure having a first side, a second side, a first end, a second end;

a panel structure having a first side, a second side, said panel structure defining a first side thickness between said first side of said reinforcing structure and said first side of said panel structure, said panel structure defining a second side thickness between said second side of said reinforcing structure and said second side of said panel structure;

said reinforcing structure having a first longitudinal member on said first side and a second longitudinal member on said second side;

at least one tab portion extending outwardly from at least one of said first longitudinal member and said second longitudinal member, said tab portion extending outwardly by a length.

24. The fence panel according to claim 23 wherein:

said at least one tab portion has a terminal end defining a widened portion.

25. The fence panel according to claim 23 wherein:

said reinforcing structure having cross-members between said first longitudinal member and said second longitudinal member, wherein said cross-members define a height between said first longitudinal member and said second longitudinal member, wherein said cross-members, said first longitudinal member and said second longitudinal member define at least one chamber.

26. The fence panel according to claim 25 wherein:

said length of said at least one tab portion is between 25% and 30% of said height of said cross-members.

27. A fence comprising:

a frame having vertical and horizontal members;

a fence panel received within said frame, said fence panel having a reinforcing structure having a first side, a second side, a first end, a second end, said fence panel having a panel structure surrounding said reinforcing structure, said panel structure having a first side and a second side, said panel structure defining a first side thickness between said first side of said reinforcing structure and said first side of said panel structure, said panel structure defining a second side thickness between said second side of said reinforcing structure and said second side of said panel structure;

said reinforcing structure having a first longitudinal member on said first side and a second longitudinal member on said second side;

at least one tab portion extending outwardly from at least one of said first longitudinal member and said second longitudinal member, said tab portion extending outwardly by a length.

28. The fence panel according to claim 27 wherein:

said at least one tab portion has a terminal end defining a widened portion.

29. The fence panel according to claim 27 further comprising:

cross-members between said first longitudinal member and said second longitudinal member, wherein said cross-members define a height between said first longitudinal member and said second longitudinal member, wherein said cross-members, said first longitudinal member and said second longitudinal member define at least one chamber.

30. The fence panel according to claim 29 wherein:

said length of said at least one tab portion is between 25% and 30% of said height of said cross-members.

* * * * *